US011938366B2

(12) United States Patent
Yang et al.

(10) Patent No.: US 11,938,366 B2
(45) Date of Patent: Mar. 26, 2024

(54) FREE WEIGHT TRAINING PROTECTION DEVICE

(71) Applicants: Zih Min Yang, New Taipei (TW); Yu Shan Kao, New Taipei (TW)

(72) Inventors: Zih Min Yang, New Taipei (TW); Yu Shan Kao, New Taipei (TW)

( * ) Notice: Subject to any disclaimer, the term of this patent is extended or adjusted under 35 U.S.C. 154(b) by 248 days.

(21) Appl. No.: 17/380,030

(22) Filed: Jul. 20, 2021

(65) Prior Publication Data

US 2022/0212054 A1 Jul. 7, 2022

(30) Foreign Application Priority Data

Jan. 5, 2021 (TW) ..... 110100202

(51) Int. Cl.

| | |
|---|---|
| ***A63B 21/078*** | (2006.01) |
| ***A63B 21/00*** | (2006.01) |
| ***A63B 21/072*** | (2006.01) |
| ***A63B 24/00*** | (2006.01) |

(52) U.S. Cl.

CPC ..... *A63B 21/0783* (2015.10); *A63B 21/0724* (2013.01); *A63B 21/154* (2013.01); *A63B 24/0087* (2013.01); *A63B 2220/13* (2013.01); *A63B 2220/17* (2013.01); *A63B 2220/50* (2013.01); *A63B 2225/02* (2013.01)

(58) Field of Classification Search

CPC ..... A63B 21/0783; A63B 21/0724; A63B 21/154; A63B 24/0087; A63B 2220/13; A63B 2220/17; A63B 2220/50; A63B 2225/02; A63B 21/0058; A63B 2024/0093; A63B 2071/0072; A63B 21/06

See application file for complete search history.

(56) References Cited

U.S. PATENT DOCUMENTS

| | | | | |
|---|---|---|---|---|
| 6,379,287 | B1 | 4/2002 | Slawinski et al. | |
| 6,669,607 | B2 | 12/2003 | Slawinski et al. | |
| 7,374,515 | B2 | 5/2008 | Slawinski et al. | |
| 7,666,118 | B1 * | 2/2010 | Anthony ..... | A63B 21/0724 482/8 |

(Continued)

FOREIGN PATENT DOCUMENTS

| | | |
|---|---|---|
| TW | M397839 | 2/2011 |
| TW | I439305 | 6/2014 |

(Continued)

*Primary Examiner* — Megan Anderson
*Assistant Examiner* — Sara K. Conway
(74) *Attorney, Agent, or Firm* — Bruce Stone LLP; Joseph A. Bruce

(57) ABSTRACT

A free weight training protection device includes a rack, two transmission modules, a control module and a barbell. The rack includes hanger structures which are configured to be laterally symmetrical to each other. The two transmission modules are configured to be laterally symmetrical to each other. Each transmission module includes a motor, sprockets, chains, pulleys and ropes. When a controller executes a fitness program, the controller operates the motor, so that the rope maintains a basic tension which is a very small tension and will not affect the hand feel of heavy training. If the barbell has an abnormal position or displacement, the controller will start a protection program to prevent the barbell from falling and move the barbell upward, so as to provide protections to users.

5 Claims, 4 Drawing Sheets

(56) References Cited

U.S. PATENT DOCUMENTS

| | | | | |
|---|---|---|---|---|
| 2005/0233871 | A1* | 10/2005 | Anders | A63B 21/0783 482/8 |
| 2012/0058859 | A1* | 3/2012 | Elsom-Cook | A63B 21/00181 482/4 |
| 2013/0190143 | A1* | 7/2013 | Greenhill | A63B 21/00181 482/104 |
| 2014/0038777 | A1* | 2/2014 | Bird | A63B 23/03525 482/5 |
| 2014/0228175 | A1* | 8/2014 | Lemos | A63B 21/0783 482/93 |
| 2020/0376321 | A1* | 12/2020 | Davis | A63B 71/0054 |
| 2021/0077884 | A1* | 3/2021 | De las Casas Zolezzi | A63B 71/0054 |
| 2022/0062687 | A1* | 3/2022 | Gao | A63B 21/0783 |

FOREIGN PATENT DOCUMENTS

| | | | |
|---|---|---|---|
| TW | M597670 | | 7/2020 |
| WO | WO-2021151127 | A1 * | 8/2021 |
| WO | WO-2022103278 | A1 * | 5/2022 |

* cited by examiner

FREE WEIGHT TRAINING PROTECTION DEVICE

BACKGROUND OF THE INVENTION

1. Field of the Invention

The present invention relates to weight training equipment, particularly free weight training protection device.

2. Description of the Prior Art

Weight training is one of the exercises that can effectively improve muscle strength, and improve the athletic performance of different aspects for young people and the body posture and cardiopulmonary function for middle-aged and elderly, and it can also solve a variety of soreness problems and delay aging. With the emergence of scientific verification and documentation, the weight training methods have become more scientific and specific, and weight training has gradually been accepted by people.

The weight training requires the operation of equipment with a certain weight (such as dumbbells, barbells, etc.), and it is very dangerous to operate these types of equipment without taking classes and training. For example, accidents happen from time to time, when one carries out heavy weight training without evaluating one's capability. Especially for special athletes, they may lose their sports carrier once they are injured accidentally.

Therefore, when professional athletes are trained, they are usually escorted by trainers and instructors to provide guidance and protection to avoid danger. However, it is very expensive to hire trainers or instructions for the general public. At present, a common fitness machine called "Smith machine" is available, and this machine controls the trajectory of the barbell by vertical tracks and hooks to provide protection to a certain extent, but such machine also limits the space of training.

Therefore, how to solve the aforementioned problem is worth consideration for the manufacturers of the related industry.

SUMMARY OF THE INVENTION

It is a primary objective of the present invention to provide a free weight training protection device connected to a barbell through a rack, two ropes, four pulleys, four chains, eight sprockets and two motors. When a controller executes a fitness program, the controller operates the motor, so that the rope maintains a basic tension which is a very small tension and will not affect the hand feel of heavy training. If the barbell has an abnormal position or displacement, the controller will start a protection program to prevent the barbell from falling and move the barbell upward, so as to provide protection to users.

The free weight training protection device comprises a rack, two transmission modules and a control module. The rack comprises at least one lower link bar, at least one upper link bar, two pedestals, two center posts, two upper arms and two barbell brackets. The pedestals are configured to be laterally symmetrical. The center posts are configured to be laterally symmetrical and disposed on the pedestals respectively. The upper arms are configured to be laterally symmetrical and disposed on the center posts respectively. The barbell brackets are configured to be laterally symmetrical and mounted onto the center posts respectively. The lower link bars are coupled to the two pedestals respectively, and the upper link bar is coupled to the two upper arms to form a stable rack.

The two transmission modules are installed on the rack, configured to be laterally symmetrical to each other, and disposed on the left side and right side of the rack respectively, and each transmission module comprises a motor, a transmission mechanism, a first sprocket, a second sprocket, a first chain, a first pulley, a second pulley, a rope, a linker and a plate-collar. The motor is installed on the pedestal, and the first sprocket is installed on the pedestal. The transmission mechanism is installed at the pedestal and capable of linking the motor and the first sprocket with power. The linker further comprises a tension sensor for providing a tension signal.

The first pulley is installed to the front side of the upper arm, and the second pulley is installed to the rear side of the upper arm, and the rope is leaned and set on the first pulley and the second pulley, and the rope is coupled to the linker. The plate-collar is disposed onto the barbell, coupled to the rope, and configured for carrying the barbell. In this embodiment, the transmission mechanism comprises a small sprocket, a large sprocket and a second chain, wherein the small sprocket and the motor are coaxially installed, and the large sprocket and the first sprocket are coaxially installed, and the second chain is mounted on the small sprocket and the large sprocket.

The control module comprises a controller, two first proximity sensors and two second proximity sensors. The first proximity sensor is installed to the left and right barbell brackets separately and configured for issuing a first trigger signal. The second proximity sensor is installed to the left and right upper arms separately and configured for issuing a second trigger signal. The controller is installed onto the rack and electrically coupled to the first proximity sensor, the second proximity sensor, the tension sensor in the linker and the motor.

The controller includes a standby program, a fitness program, a calibration program and a protection program. The controller further comprises two independent rope basic tension control program and two independent barbell position calculation programs, and they are a left rope basic tension control program, a right rope basic tension control program, a left barbell position calculation program, a right barbell position calculation program respectively.

When the barbell is placed on the barbell bracket, the barbell-bar triggers the first barbell detector to issue a first trigger signal, and after the controller receives the first trigger signal, the controller starts the standby program. In the standby program, several setup instructions can be inputted into the controller. When the barbell leaves the barbell bracket, the first trigger signal is removed, and the controller starts the fitness program. In addition, if the controller executes the fitness program and the barbell position data and the displacement data are abnormal, the controller will immediately start the protection program to prevent the barbell from falling and to moving the barbell upwardly to a ready position.

When the controller executes the standby program or fitness program, the barbell brackets or user bears the weight of the barbell. The controller must execute the left rope basic tension control program to drive the left motor for keeping the basic tension on the left rope, and the controller must execute the right rope basic tension control program to drive the right motor for keeping the basic tension on the right rope. In this embodiment, the rope basic tension control program is operated as follows: Step 1: The controller sets the motor to a torque mode; Step 2: The controller receives the tension signal from the tension sensor; Step 3: The tension signal is subtracted from the basic tension setup value, and then a proportional integration operation is processed to generate a torque command, so that the motor will be operated according to the torque command, and the tension of the rope will be set to be equal to the basic tension set value.

After the free weight training protection device is powered on, the controller must start the calibration program. In this embodiment, the calibration program is operated as follow: Step 1: When the power is off, the barbell-bar is placed on the pedestal; Step 2: After the power is turned on and confirm to execute the calibration program in human-machine interface, the calibration program runs; Step 3: The controller starts the rope basic tension control program to tighten the loose rope, then the controller starts the barbell position calculation program; Step 4: The controller clears the record value of the left counter, the record value of the right counter, the left position calibration value and the right position calibration value; Step 5: The controller sets the motor to a speed mode, and instructs the motor to rotate at a low speed in a forward direction, and the left side and right side of barbell-bar are lifted at the same speed; Step 6: After the barbell-bar triggers the second proximity sensor, a second trigger signal is generated, and after the controller receives the second trigger signal, the motor is operated at a zero speed in order to fix the barbell-bar to the highest position of the center post, and save the record value of the left counter as a left position calibration value, and save the record value of the right counter as a right position calibration value; Step 7: The controller instructs the motor to rotate in the backward direction. The barbell-bar moves downwardly to the pedestal; Step 8: The user operates the human-machine interface to confirm the completion of the calibration procedure, and after the controller receives the confirmed instruction, the controller restarts the rope basic tension control program, and ends the calibration program.

If the controller executes the fitness program and the barbell position data and the displacement data are abnormal, the controller will immediately start the protection program. In this embodiment, the protection program is operated as follows: Step 1: After the protection program starts, the controller sets the motor to a speed mode, and the motor is operated at zero speed to prevent the barbell from falling; Step 2: The plate-collar at a lower horizontal position is ascended to the horizontal position of the other plate-collar, and the plate-collar at a higher horizontal position remains still; Step 3: After the two plate-collars are in the same position, the two plate-collars will be moved upwardly to the ready position with the same speed synchronously. Then the motor is operated at zero speed to fix the barbell in the ready position; Step 4: After the user moves to a safe area and operates the human-machine interface to descend the barbell onto the pedestal, and then removes the barbell plate; Step 5: The user operates the human-machine interface to confirm the completion of the protection procedure, and after the controller receives the confirmed instruction, the controller restarts the rope basic tension control program, and ends the protection program.

Wherein, when the barbell displacement data indicates a downward movement and the speed is greater than a safety value, the controller immediately starts the protection program. Wherein, if the barbell position data is lower than the ready position and the barbell position data has not changed within a certain time, the controller will immediately start the protection program. Wherein, when the barbell displacement data indicates an upward movement, if the barbell position has not reached the ready position and reverse downturn, the controller will immediately start the protection program. Wherein, if the barbell position data is lower than the lowest position, the controller will immediately start the protection program. Wherein, if the difference between the left side and right side barbell position data exceeds an allowable value, the controller will immediately start the protection program.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1A:
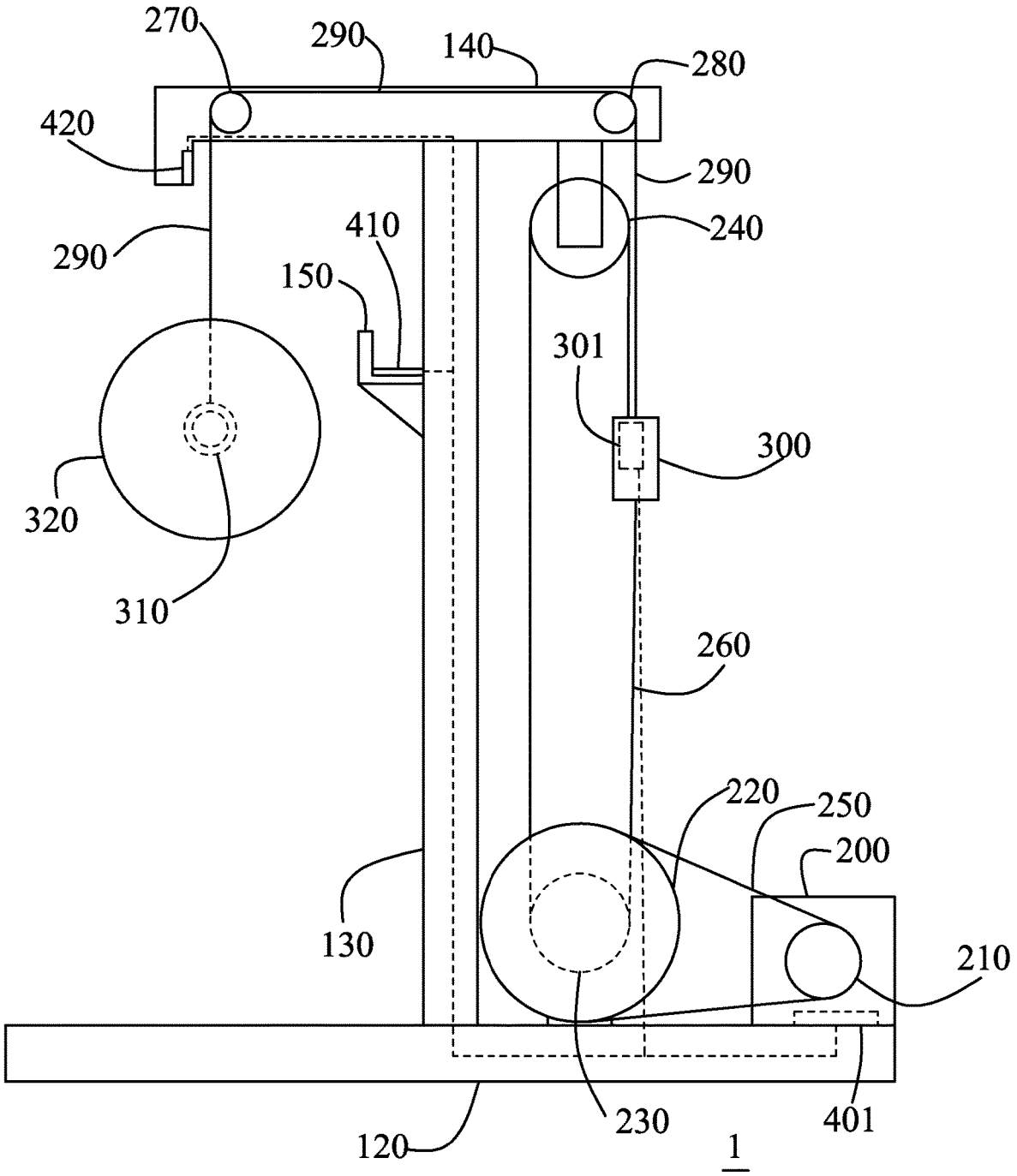
FIG. 1A shows a right schematic view of a free weight training protection device.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

The objectives, technical characteristics and effects of the present invention will become apparent with the detailed description of preferred embodiments accompanied with the illustration of related drawings. It is intended that the embodiments and drawings disclosed herein are to be considered illustrative rather than restrictive.

The present invention discloses a free weight training protection device capable of maintaining a mild tension of a rope, detecting the position and movement of a barbell by calculation, determining a user's status, and pulling up the barbell by a motor to prevent injuries before the occurrence of possible danger.

Figure 1B:
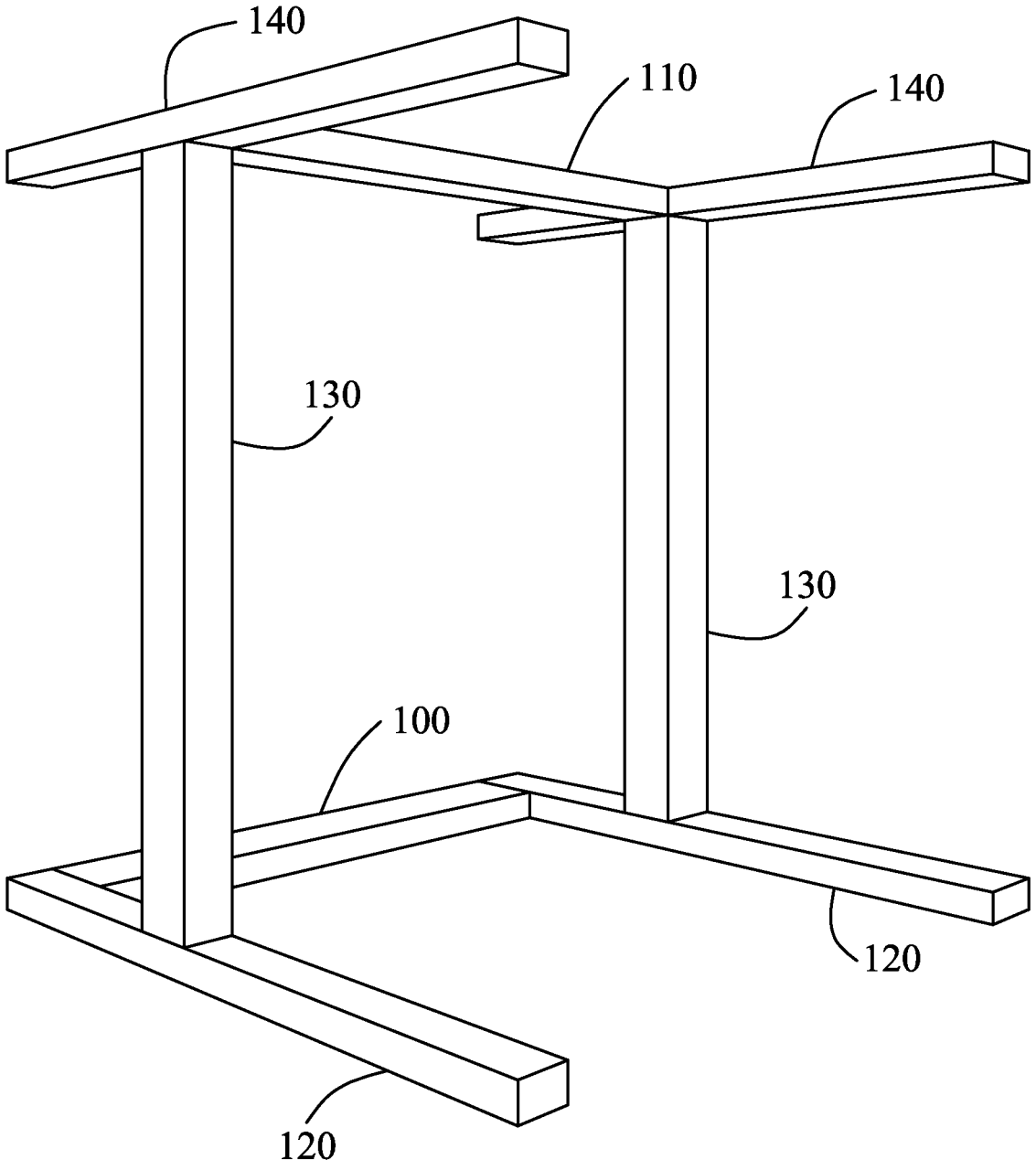
FIG. 1B shows a schematic view of a rack of the free weight training protection device.
Figure 1C:
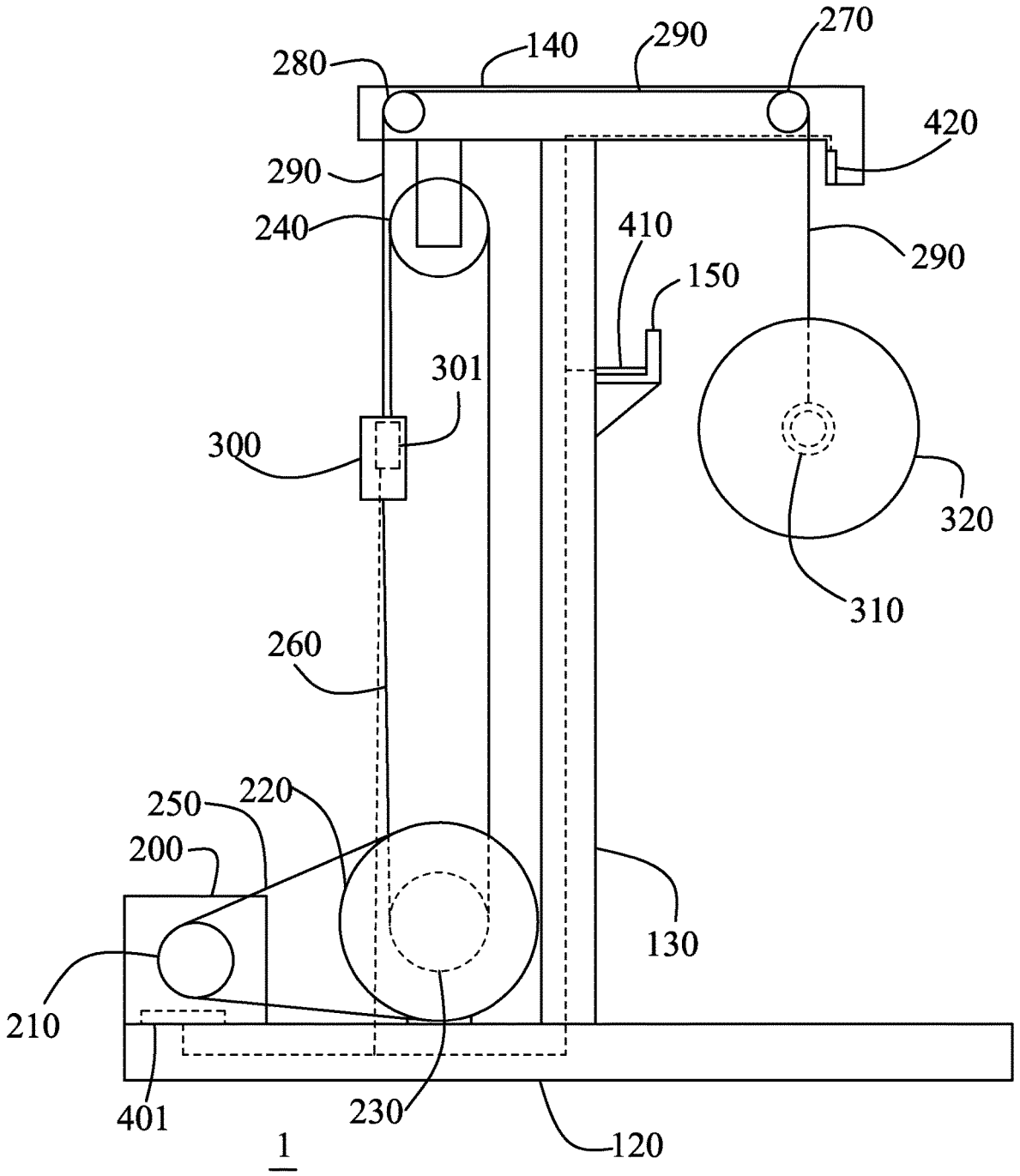
FIG. 1C shows a left schematic view of a free weight training protection device.

With reference to FIG. 1A to FIG. 1C for the right and left schematic view of a free weight training protection device and the schematic view of a rack of the free weight training protection device in accordance with the present invention respectively, the free weight training protection device 1 comprises a rack, two transmission modules and a control module.

Wherein, the rack comprises at least one lower link bar 100, at least one upper link bar 110, two pedestals 120, two center posts 130, two upper arms 140 and two barbell brackets 150. All of the pedestals 120, the center posts 130, the upper arms 140 and the barbell brackets 150 are configured to be laterally symmetrical. The center posts 130 are disposed on the pedestals 120 respectively, and the barbell brackets 150 are mounted onto the center posts 130 respectively, and the upper arms 140 are disposed on the center posts 130 respectively, and the lower link bars 100 are coupled to the two pedestals respectively, and the upper link bar 110 is coupled to the two upper arms 140 to form a stable rack.

The two transmission modules are installed on the rack, configured to be laterally symmetrical to each other, and disposed on the left side and right side of the rack respectively, and each transmission module comprise a motor 200, a transmission mechanism, a first sprocket 230, a second sprocket 240, a first chain 260, a first pulley 270, a second pulley 280, a rope 290 and a linker 300. The motor 200 is installed on the pedestal 120, and the first sprocket 230 is installed on the pedestal 120. The transmission mechanism is installed at the pedestal 120 and capable of linking the motor 200 and the first sprocket 230 with power. The second sprocket 240 is hung from the bottom of the upper arm 140, and the first chain 260 is mounted onto the first sprocket 230 and the second sprocket 240, wherein, the first chain 260 has an end coupled to the upper end of the linker 300 and the other end coupled to a lower end of the linker 300. The first pulley 270 is installed to the front side of the upper arm 140, and the second pulley 280 is installed to the rear side of the upper arm 140, and the rope 290 is leaned and set on the first pulley 270 and the second pulley 280, and the front end of the rope 290 is coupled to a plate-collar 310, and an end of the rope 290 is coupled to an upper end of the linker 300. In addition, the rope 290 at an upper end of the linker 300 and the first chain 260 at the lower end of the linker 300 are situated in the same straight line. In an embodiment, the linker 300 further comprises a tension sensor 301 for providing a tension signal.

In this embodiment, the transmission mechanism comprises a small sprocket 210, a large sprocket 220 and a second chain 250, wherein the small sprocket 210 and the motor 200 are coaxially installed, and the large sprocket 220 and the first sprocket 230 are coaxially installed, and the second chain 250 is mounted on the small sprocket 210 and the large sprocket 220. In addition, the numbers of teeth of the small sprocket 210, the large sprocket 220, the first sprocket 230 and the second sprocket 240 are 15, 60, 15 and 15 respectively, and the rope 290 is an inelastic rope.

When the motor 200 rotates the small sprocket 210 in the forward direction, the small sprocket 210 rotates the large sprocket 220 by the second chain 250, and the large sprocket 220 directly rotates the first sprocket 230, and the first sprocket 230 rotates the second sprocket 240 by the first chain 260, so as to drive the linker 300 to move downward, and the linker 300 drives the plate-collar 310 to move upward by the rope 290. On the contrary, when the plate-collar 310 moves downward, the linker 300 is driven to move upward by the rope 290 to further drive the motor 200 to rotate in a reverse direction.

The control module comprises a controller 401, two first proximity sensors 410 and two second proximity sensors 420. The first proximity sensor 410 is installed to the left and right barbell brackets 150 separately, and the second proximity sensor 420 is installed to the left and right upper arms 140 separately. The controller 401 is a main component for controlling the free weight training protection device 1 and it is electrically coupled to tension sensors 301 of the two linkers 300, the two first proximity sensors 410, the two second proximity sensors 420 and the two motors 200. In this embodiment, the first proximity sensor 410 and the second proximity sensor 420 are ferrous-metal detectors. When a barbell-bar is close to the first proximity sensor 410 or the second proximity sensor 420, a first trigger signal or a second trigger signal will be generated.

The controller 401 includes a standby program, a fitness program, a calibration program and a protection program. The controller 401 further comprises two independent rope basic tension control program and two independent barbell position calculation programs, and they are a left rope basic tension control program, a right rope basic tension control program, a left barbell position calculation program, a right barbell position calculation program respectively.

When the barbell 320 is placed on the barbell bracket 150, the barbell-bar triggers the first proximity sensor 410 to issue a first trigger signal, and after the controller 401 receives the first trigger signal, the controller 401 starts the standby program. In the standby program, several setup instructions can be inputted into the controller 401, and users can adjust the quantity of barbell plates. When the barbell 320 leaves the barbell bracket 150, the first trigger signal is removed, and the controller 401 starts the fitness program, so that the users can perform professional weight training. In addition, if the controller 401 executes the fitness program and the barbell position data and the displacement data are abnormal, the controller 401 will immediately start the protection program to prevent the barbell 320 from falling and to move the barbell 320 upwardly to a ready position.

If the controller 401 executes the fitness program or standby program, the user's force or barbell brackets can offset the weight of the barbell 320. Without proper actions, the rope 290 will become loose, and the motor 200 will be unable to immediately transmit the tension to the barbell 320. Therefore, when the controller 401 executes the fitness program and standby program, the controller 401 must execute the left rope basic tension control program to drive the left motor for keeping the basic tension on the left rope, and the controller 401 must execute the right rope basic tension control program to drive the right motor for keeping the basic tension on the right rope In this embodiment, the rope basic tension control program is operated as follows: Step 1: The controller 401 sets the motor 200 to a torque mode; Step 2: The controller 401 receives the tension signal from the tension sensor 301; Step 3: The tension signal is subtracted from the basic tension setup value, and then a proportional integration operation is processed to generate a torque command, so that the motor 200 will be operated according to the torque command, and the tension of the rope 290 will be set to be equal to the basic tension set value.

After the free weight training protection device 1 is powered on, the controller 401 must execute the calibration program. In the calibration program, the controller 401 starts the left barbell position calculation program and the right barbell position calculation program, and the barbell position calculation program is executed permanently and there is no condition to end the program. In this embodiment, the controller 401 comprises a left counter and a right counter, and the left motor 200 further comprises a left rotary encoder, and the right motor 200 further comprises a right rotary encoder, and the barbell position calculation program is operated as follows: Step 1: The controller 401 receives a pulse signal from the rotary encoder of the motor and the left counter and the right counter are used to record the quantity of pulse signals (when the motor 200 rotates in a forward direction, the counter counts up the number of pulses, and when the motor 200 rotates in a reverse direction, the counter counts down the number of pulses, which is the record value); Step 2: The length of the center post 130 is divided by a position calibration value, and then multiplied by the record value of the counter to obtain the height position of the barbell 320.

In addition, the controller 401 can use the length of each clock loop (dt) to read a variation of the record value of the counter, calculate a change of position of the barbell 320, and further calculates the movement of the barbell 320.

Specifically, the "present position" minus the "last position" to obtain the variation of the position, wherein a negative variation indicates that the barbell 320 is descending; a positive variation indicates that the barbell 320 is ascending; a variation fluctuating at a zero value indicates that the barbell 320 is still. The larger the variation, the faster the moving speed. The smaller the variation, the slower the moving speed. These constitute the barbell displacement data.

After the free weight training protection device 1 is powered on, the controller 401 must start the calibration program. In this embodiment, the calibration program is operated as follow: Step 1: When the power is off, the barbell-bar is placed on the pedestal 120; Step 2: After the power is turned on and confirm to execute the calibration program in human-machine interface, then the calibration program runs; Step 3: The controller 401 starts the rope basic tension control program to tighten the loose rope, then the controller 401 starts the barbell position calculation program; Step 4: The controller 401 clears the record value of the left counter, the record value of the right counter, the left position calibration value and the right position calibration value; Step 5: The controller 401 sets the motor 200 to a speed mode, and instructs the motor 200 to rotate at a low speed in a forward direction, and the left side and right side of barbell-bar are lifted at the same speed; Step 6: After the barbell-bar triggers the second proximity sensor 420, a second trigger signal is generated, and after the controller 401 receives the second trigger signal, the motor 200 is operated at a zero speed in order to fix the barbell-bar to the highest position of the center post 130, and save the record value of the left counter as a left position calibration value, and save the record value of the right counter as a right position calibration value; Step 7: The controller 401 instructs the motor 200 to rotate in the backward direction. The barbell-bar moves downwardly to the pedestal; Step 8: The user operates the human-machine interface to confirm the completion of the calibration procedure, and after the controller 401 receives the confirmed instruction, the controller 401 restarts the rope basic tension control program, and ends the calibration program.

In this embodiment, the protection program is operated as follows: Step 1: After the protection program starts, the controller 401 sets the motor 200 to a speed mode, and the motor 200 is operated at zero speed to prevent the barbell 320 from falling; Step 2: The plate-collar 310 at a lower horizontal position is ascended to the horizontal position of the other plate-collar 310, and the plate-collar 310 at a higher horizontal position remains still; Step 3: After the two plate-collars are in the same position, the two plate-collars will be moved upwardly to the ready position with the same speed synchronously. Then the motor is operated at zero speed to fix the barbell in the ready position; Step 4: After the user moves to a safe area and operates the human-machine interface to descend the barbell 320 onto the pedestal 120, and then removes the barbell plate; Step 5: The user operates the human-machine interface to confirm the completion of the protection procedure, and after the controller 401 receives the confirmed instruction, the controller 401 restarts the rope basic tension control program, and ends the protection program.

Wherein, when the barbell displacement data indicates a downward movement and the speed is greater than a safety value, the controller 401 immediately starts the protection program. For example, if a user suddenly releases the barbell 320 during exercise, and the barbell 320 falls quickly, then the protection program will immediately stop the barbell 320 from falling and then lift the barbell 320 to protect the user.

Wherein, if the barbell position data is lower than the ready position and the barbell position data has not changed within a certain time, the controller 401 will immediately start the protection program. For example, when a user squats with the barbell 320 and fails to lift the barbell 320 after the squat, the user sticks to the same position, the protection program will stop and prevent the barbell 320 from descending, and then lift the barbell 320 to protect the user.

Wherein, when the barbell displacement data indicates an upward movement, if the barbell position has not reached the ready position and reverse downturn, the controller 401 will immediately start the protection program. For example, if the user is lifting the barbell 320 and unable to continue pushing up the barbell 320 to ready position, so that the barbell 320 has not reached the ready position, the barbell 320 will descend. Now, the protection program stops and prevents the barbell 320 from descending, and then lifts the barbell 320 to protect the user.

Wherein, if the barbell position data is lower than the lowest position, the controller 401 will immediately start the protection program. For example, when the user is pressed by the heavy weight of the barbell 320, the protection program stops the barbell 320 from descending, and then lifts the barbell 320 to protect the user.

Wherein, if the difference between the left and right barbell position data exceeds an allowable value, the controller 401 will immediately start the protection program. For example, when the user's strength is insufficient, so that the barbell 320 is tilted sideway. Now, the protection program stops the barbell 320 from descending and then lifts the barbell 320 to protect the user.

Figure 2:
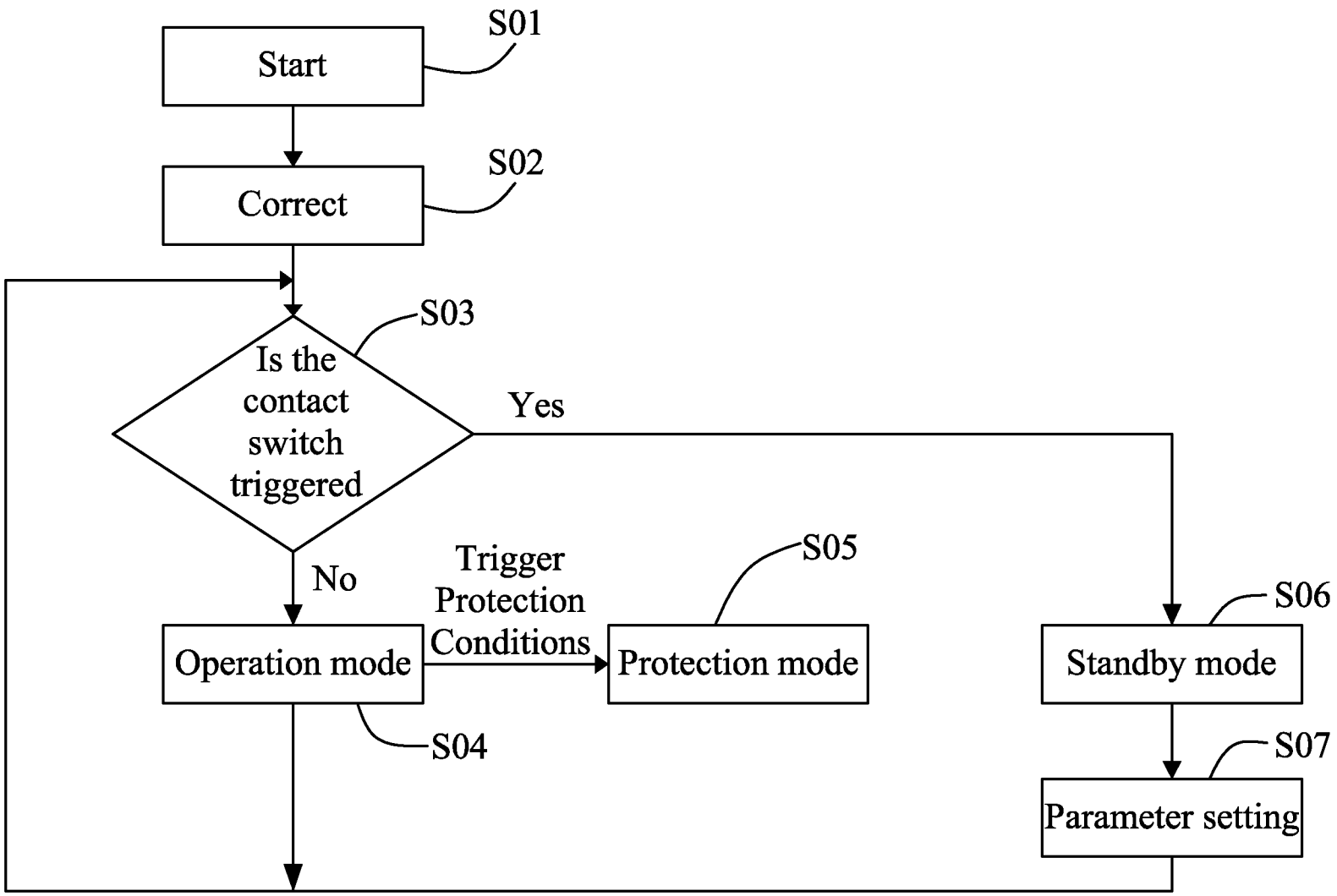
FIG. 2 shows the flow chart of operating the free weight training protection device.

With reference to FIG. 2 for the flow chart of operating the free weight training protection device, the free weight training protection device 1 is turned on (S01), and calibrated (S02). Whether or not the barbell 320 is situated at the barbell bracket 150 is determined by the occurrence of the trigger of the first proximity sensor 410 (S03). If the first proximity sensor 410 has not been triggered, then the fitness program will be run (S04), and users can perform training under the fitness program. If the fitness program is triggered by the required protection conditions, then the protection program will be run (S05). If the first proximity sensor 410 is triggered, then the standby mode will be entered (S06), and parameters can be set in the standby mode (S07).

In summation, the free weight training protection device 1 of the present invention can monitor the position and displacement status of the barbell 320 while the users are using the barbell 320 for training. Once if the position of the barbell 320 is incorrect, or the displacement of the barbell 320 is abnormal, the controller 401 will drive the motor 200 to stop the barbell 320 from descending and lift the barbell 320 to protect the user from being injured. Under normal conditions, the controller 401 will also drive the motor 200 to maintain a basic tension of the rope 290, so as to ensure that the motor 200 can immediately drive the barbell 320 to stop and provide immediate protections.

While the preferred embodiment of the invention has been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

We claim:

1. A free weight training protection device, applicable for carrying a barbell, comprising:

a rack, two transmission modules, and a control module;

the rack, comprising:

two pedestals, configured to be laterally symmetrical to each other;

two center posts, configured to be laterally symmetrical to each other, and disposed on the two pedestals, respectively;

two barbell brackets, configured to be laterally symmetrical to each other, and mounted onto the two center posts, respectively;

two upper arms, configured to be laterally symmetrical to each other, and disposed on the two center posts respectively; and at least one link bar, disposed between the two pedestals or between the two upper arms;

the two transmission modules, disposed on the two pedestals at both left and right sides of the rack, respectively, and each of the two transmission modules comprising:

a motor, installed on the corresponding pedestal;

a first sprocket, installed on the corresponding pedestal;

a transmission mechanism, linked to the corresponding motor and the corresponding first sprocket;

a second sprocket, hung from a bottom of the corresponding upper arm;

a first chain, mounted on the first sprocket and the second sprocket;

a linker with opposing ends thereof coupled to the first chain, the linker comprising a tension sensor;

a first pulley, installed at a front end of the corresponding upper arm;

a second pulley, installed at a rear end of the corresponding upper arm;

a rope, mounted on the first pulley and the second pulley, and coupled to the linker; and a plate-collar, coupled to the rope, and applicable for carrying the barbell; and the control module, comprising:

two first proximity sensors, installed onto the two barbell brackets, respectively, for providing a first trigger signal;

two second proximity sensors, installed onto front sides of the two upper arms, respectively, for providing a second trigger signal; and a controller, installed on the rack, and electrically coupled to the two first proximity sensors, the two second proximity sensors, the two tension sensors, and the two motors;

wherein, the controller comprises two basic tension control programs for the two ropes, respectively, for controlling the two motors to enter into a torque mode, respectively;

wherein, the controller further comprises two barbell position calculation program for calculating position data of the two plate-collars respectively;

and wherein, the controller further comprises a protection program, such that when the controller executes the protection program, each motor of the two motors is set to a speed mode, and then each of the motors is set to a zero speed operation mode, and then one of the two plate-collars located at a lower horizontal position relative to the other of the two plate-collars is pulled up until the position data of the two plate-collars is the same, and then the two plate-collars are pulled up synchronously until the position data of the two plate-collars reaches a ready position.

2. The free weight training protection device of claim 1, wherein each of the tension sensors provides a tension signal, and when the controller executes the two basic tension control programs, output torques of the two motors are controlled according to the two tension signals, respectively.

3. The free weight training protection device of claim 1, wherein the controller comprises a left counter and a right counter, and each of the motors further comprises a rotary encoder;

wherein, when the controller executes the two barbell position calculation programs, the controller uses the left counter and the right counter to respectively count a number of pulses of the rotary encoder of the two motors, wherein when the each of the motors rotate rotates in a forward direction, the corresponding counter counts up the number of pulses, and wherein when each of the motors rotate rotates in a reverse direction, the corresponding counter counts down the number of pulses;

wherein, each position data of the two plate-collars is equal to a recorded value of the number of pulses of the corresponding counter times a height of the corresponding center post, and then divided by a corresponding position calibration value; wherein after the free weight training protection device is powered on, the controller immediately starts the two barbell position calculation programs and maintains the operation of the two barbell position calculation programs.

4. The free weight training protection device of claim 3, wherein the controller further comprises a calibration program, wherein when the controller executes the calibration program, and the barbell is placed on the two pedestals, the controller clears the recorded values of the corresponding counters and the corresponding position calibration values, and then drives the two motors to respectively ascend the two plate-collars until the second trigger signal has been received, then stops driving the two motors, then saves the recorded value of the left counter as the left position calibration value, and then saves the recorded value of the right counter as the right position calibration value.

5. The free weight training protection device of claim 3, wherein if the barbell displacement data indicates a downward movement and a speed is greater than a safety value, the controller will start the protection program;

wherein, if the position data of the two plate-collars is lower than the ready position and the position of the two plate-collars has not changed within a first certain time, the controller will start the protection program;

wherein, if the barbell displacement data indicates an upward movement and the position data of the two plate-collars has not reached the ready position within a second certain time, the controller will start the protection program;

wherein, if the position data of the two plate-collars is lower than the lowest position, the controller will start the protection program; and wherein, if a difference between the position data of the two plate-collars exceeds an allowable value, then the controller will start the protection program.

* * * * *